United States Patent [19]

Greenberg

[11] Patent Number: 4,844,633

[45] Date of Patent: Jul. 4, 1989

[54] ACTIVE PAPER DROP MECHANISM FOR A PRINTER

[75] Inventor: Michael D. Greenberg, Decatur, Ga.

[73] Assignee: Hewlett-Packard Company, Palo Alto, Calif.

[21] Appl. No.: 211,030

[22] Filed: Jun. 24, 1988

[51] Int. Cl.[4] ..... B41J 3/02

[52] U.S. Cl. ..... 400/120; 101/419; 271/189; 400/647.1

[58] Field of Search ..... 400/120, 628, 642, 646, 400/647, 674.1; 101/93.04, 416 R, 419, 420; 271/189

[56] References Cited

U.S. PATENT DOCUMENTS

| | | | |
|---|---|---|---|
| 925,576 | 6/1909 | Gibbs | 400/647.1 |
| 1,727,402 | 9/1929 | Garbell | 400/647.1 |
| 1,972,070 | 8/1934 | Jacobsen et al. | 101/419 |
| 2,619,034 | 11/1952 | Bailey | 101/419 |
| 2,686,471 | 8/1954 | Jolley | 101/419 |
| 4,700,200 | 10/1987 | Hibino | 400/120 |
| 4,775,869 | 10/1988 | Minowa | 400/120 |

*Primary Examiner*—Eugene N. Eickholt

[57] ABSTRACT

A sheet of paper, upon which characters have been printed by a printhead, is stacked at a collection station using a mechanism that conveys the sheet to a position above a stack of previously printed sheets, while supporting the sheet so that it does not contact the top sheet in the stack as it is conveyed. When the sheet is directly above the stack, the sheet is dropped vertically downwardly in a manner such that there is very little, if any, sliding between the sheet that is dropped and the top sheet in the stack. The possibility of smearing undried ink on the top sheet of the stack is thereby minimized. The active paper drop mechanism preferably includes a pair of pivotally mounted arms that gradually pivot under the sheet as it is conveyed, to support the sheet, and then rapidly swing out of the way so that the sheet falls downwardly.

18 Claims, 3 Drawing Sheets

FIG. 1
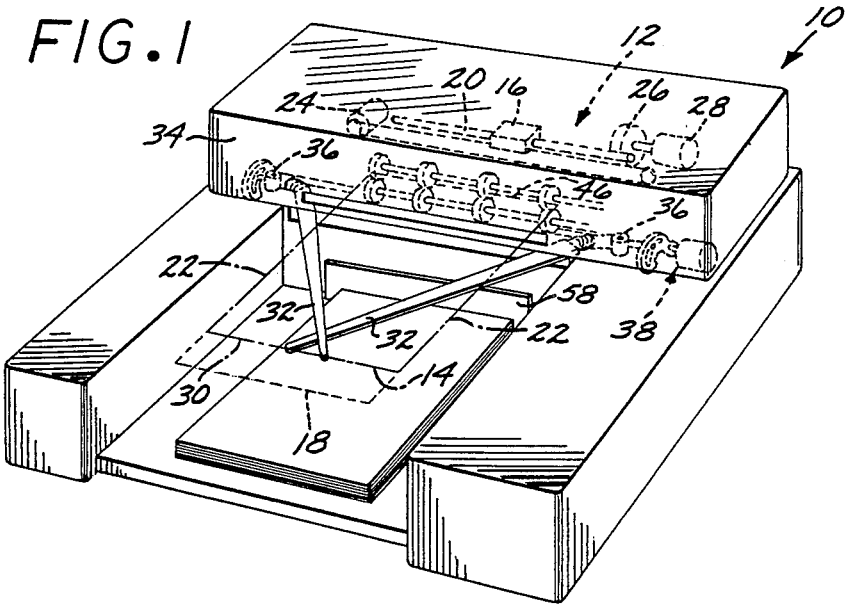
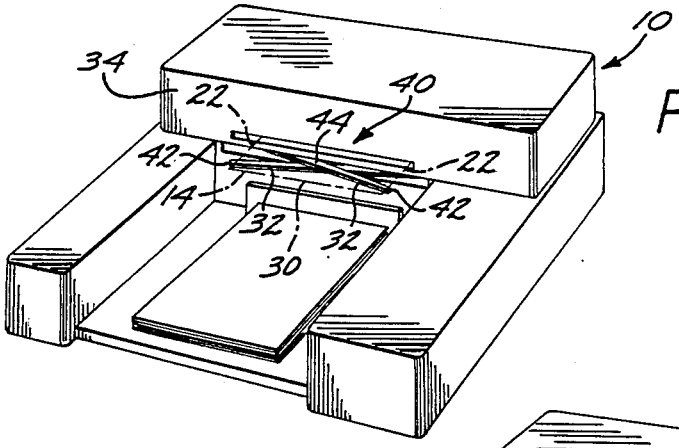
FIG. 2
FIG. 3
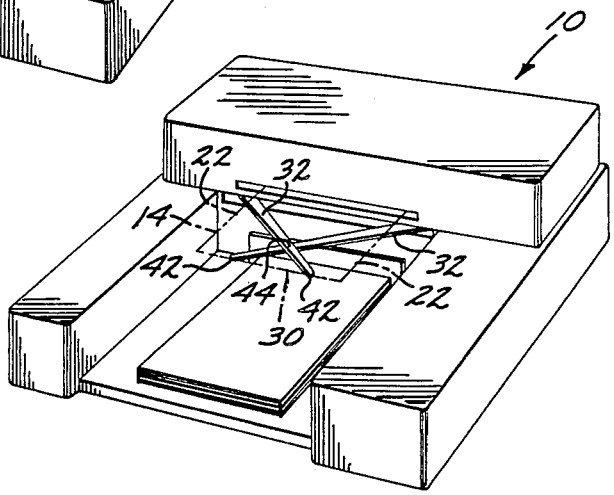

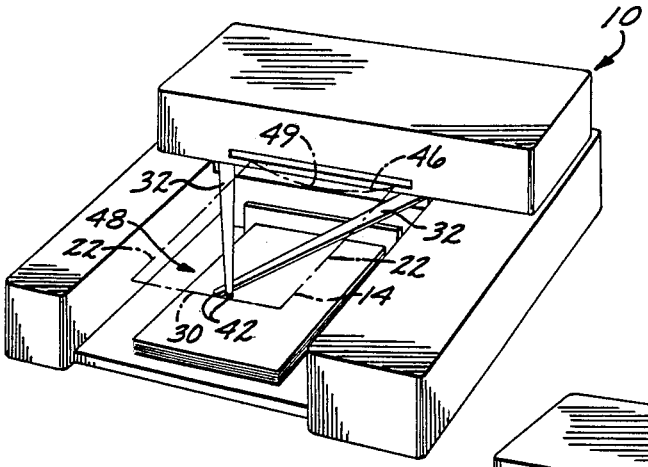
FIG. 4
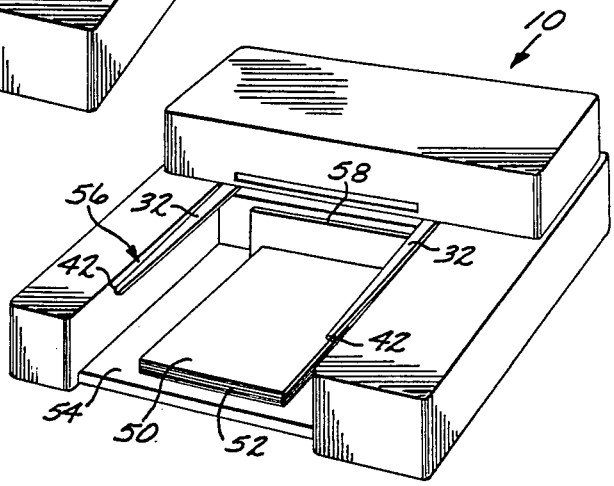
FIG. 5
FIG. 6
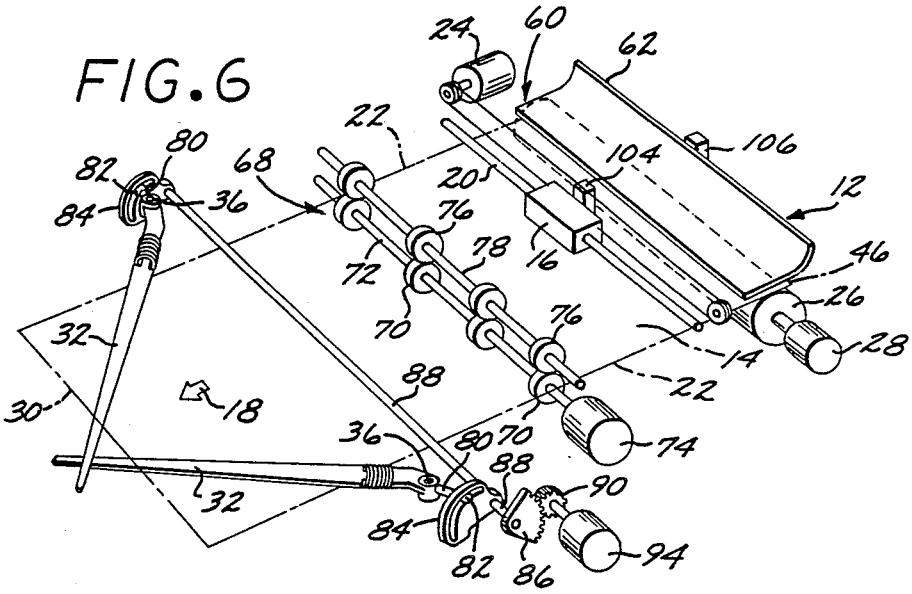

ACTIVE PAPER DROP MECHANISM FOR A PRINTER

BACKGROUND OF THE INVENTION

This invention relates to printers that print characters on sheets of a printing medium and, more particularly, to a mechanism that deposits each completed sheet onto a collection stack.

Printers are devices that print characters onto a printing medium such as a sheet of paper, and then deposit the sheets onto a stack for later pickup by the user of the printer. Printers are of many types, and are commonly linked to a computer that supplies the text or figures that are to be printed. The present invention relates to sheet printers, which print on single sheets of paper, as distinct from printers that print onto a continuous printing medium that may later be separated into individual sheets.

Many printers use a pigment-containing liquid, generally termed an ink, to form the characters on the printing medium. (By contrast, other printers use a dry toner to form the characters.) The printer delivers the ink to the medium in the proper pattern using a printhead that creates the proper patterning. One important type of printhead is the ink jet printhead, which forms small streams or droplets of ink that are ejected toward the printing medium in the pattern that forms the characters. The droplets strike the medium and then dry to form the permanently printed characters. The drying occurs by a combination of absorption into the printing medium and evaporation of the liquid component of the ink.

The drying of the droplets takes some time, depending upon the content and composition of the ink, the weather (increased humidity slows the drying process), and the character of the printing medium. Different types of paper absorb the ink and permit it to dry at different rates. Specially treated papers that cause rapid drying of the ink are available for ink jet and other types of printers that use liquid inks, and such types of papers are recommended for use with such printers. One type of absorbent paper utilizes a thin, highly absorbent clay coating. Alternatively, other methods such as heaters or air jets can be used to accelerate the drying of the ink, but such methods increase the cost, weight, and complexity of the printer.

Many users of liquid-ink printers utilize conventional paper, not treated to accelerate drying, in their printers. The deposited ink dries much more slowly on the conventional paper than when the proper treated paper is used. As a result, there is an increased tendency for the ink to smear on the top sheet of the stack as the next sheet is conveyed onto the stack, and the bottom of the next sheet slides over the top of the top sheet. The user of the printer is likely to be unsatisfied with the results, and may blame the printer for the smeared characters rather than recognize that the use of the incorrect paper is responsible. This problem becomes particularly acute as printers are made to operate at increasingly high speeds, reducing the time available for the ink to dry on a sheet before the next sheet slides across it.

There therefore exists a need for an approach to reduce the smearing of ink on the previously deposited top sheet of a stack, as the next sheet is completed and deposited thereupon. The present invention fulfills this need, and further provides related advantages.

SUMMARY OF THE INVENTION

The present invention provides an apparatus and mechanism for depositing successive sheets of printing medium onto a stack, while minimizing the possibility of smearing of the ink on each sheet as the next sheet is deposited. The mechanism is compact, and is no larger in extent that the sheets themselves. When not in use, it folds to a position that is out of the way and not likely to be damaged when the printer is used. The mechanism is light and adds little to the weight of the printer.

In accordance with the invention, a printer comprises means for printing characters on sheets of a printing medium; means for conveying the sheets of the printing medium from the means for printing, along a printing medium path to a path end position overlying a collection station whereat a stack of the sheets is formed; and means for stacking the sheets at the collection station, the means for stacking including movable support arm means for supporting each sheet over the stack as the sheet is conveyed along the printing medium path to the path end position by the means for conveying, and for permitting the sheet to fall onto the stack after the sheet reaches the path end position, the support arm means including a support arm disposed to be selectively positionable under the central portion of the sheet as the sheet moves along the printing medium path.

More specifically and in a preferred embodiment, a printer comprises means for printing characters on sheets of a printing medium; means for conveying the sheets of the printing medium from the means for printing, along a printing medium path to a path end position overlying a collection station whereat a stack of the sheets is formed; and two movable support arms, each support arm being pivotally supported from a location laterally adjacent the printing medium path by an axle that is perpendicular to the printing medium path so that the support arm may pivot in a plane parallel to that of the printing medium path, from a first position wherein the arm is transversely disposed across and below the printing medium path, to a second position wherein the arm is angularly disposed across and below the printing medium path, to a third position whereat the arm is not below the printing medium path so that the printing medium can fall to lie upon the stack; and a drive mechanism that controllably pivots each support arm from its first position to its second position to its third position and then back to its first position after the sheet has fallen. (Terms such as parallel and perpendicular are used herein to describe approximate relationships, and absolute geometrical relationships are not required unless so stated.)

Also in accordance with the invention, a printer comprises a paper conveyor that grasps a sheet of paper and moves the paper; a printhead slidably mounted so that it may be traversed past the sheet of paper moved by the paper conveyor, in the direction transverse to the motion of the sheet; a pair of support arms mounted from axles positioned on either side of the path followed by the sheet of paper as it moves on the paper conveyor after it has passed the printhead; and a motor that causes the support arms to pivot on their respective axles, between a position whereat the arms are positioned across, and below, the sheet of paper, and a position whereat the arms are not below the sheet of paper, so that the sheet may fall.

In one form of the invention, as the characters are printed on the paper or other printing medium, the paper is conveyed along a paper path and past the printing means, which is typically a printhead that reciprocates transversely to the paper path to deposit ink in the required pattern. The paper is conveyed past the printhead by a frictional drive system that gently grasps the paper, as by robber wheels acting against a plate having a low coefficient of friction or against idler wheels. The movement of the paper conveyor is coordinated with the movement of the printhead, so that the paper is incrementally advanced as each line of printing is completed.

The paper gradually and incrementally advances out of the region of the printhead. When printing on that sheet of paper is completed, the sheet is deposited on the top of the stack that is formed in a collection tray positioned at a convenient location near the point where the paper would naturally fall as the drive system forces it to a point where the drive elements no longer engage the paper. In the absence of the active paper drop mechanism, the leading edge of the sheet would advance along the paper path with the sheet remaining generally planar. Eventually, however, the leading edge of the sheet would droop downwardly under the force of gravity. The underside of the leading edge would slide across the top surface of the top sheet that is already deposited upon the stack, tending to smear any undried ink that remained on the top sheet.

The active paper drop mechanism of the present invention supports the advancing sheet that is being printed in the paper path until the sheet is directly above the top of the stack, a location known as the path end position. The mechanism then permits the sheet to drop to the stack in a gentle dropping and pivoting motion that minimizes any sliding between the sheet being deposited and the top sheet on the stack. The possibility of smearing the ink is reduced because the previously deposited top sheet has a longer time to dry before the next sheet is deposited, and because there is very little sliding motion that would smear undried ink. Even if undried ink remains on the previously deposited sheet, it is likely to be undisturbed or, at the most, to be gently blotted by the back side of the sheet deposited over it.

The preferred paper drop mechanism includes a pair of lightweight support arms made of plastic that are of a length a few inches shorter than the length of the sheet of paper. The support arms are supported on axles, one adjacent each transverse edge of the paper as it emerges from the region of the printhead. The axles are displaced outwardly from the edges of the sheet of paper, so that the paper passes between the axles as it advances. The arms pivot on their respective axles, from a first position whereat they are folded against the face of the printer and extend transversely across the paper, to a second position at which they are crossed in the manner of scissors at an angle to the paper. In the first position and the second position, and at intermediate positions between the two, the arms are below the sheet of paper, so that the sheet of paper is supported against the top surfaces of the arms, as necessary. The arms are then pivoted further outwardly to a third position at which they extend perpendicular to the housing of the printer, and are no longer below the sheet of paper, so that it falls to lie on the stack of previously printed sheets.

The support arms are positioned at a height such that they are slightly below the paper path that the sheet follows as it moves forwardly. Initially, as the sheet begins to emerge from the printhead, the arms are in their first or folded position. As the sheet incrementally advances, the arms are incrementally pivoted toward their second or scissors position, with the rate of pivoting related to the rate of the advance of the sheet so that the ends of the arms are slightly behind the forward edge of the sheet. Eventually, the printing on the sheet is complete, and the paper conveying system moves the sheet to its maximum extent of travel, a path end point that places the sheet directly over the top of the previously deposited sheet on the paper stack. Although the sheet is directly above the top of the stack, it is displaced vertically upwardly because of the support provided by the support arms in their second position. The support arms then are pivoted further outwardly to their third position, where they no longer support the sheet, and it falls to the stack.

As the sheet falls to the stack, there is virtually no sliding of the falling sheet over the previously deposited sheet. The sheet falls generally vertically downwardly, without a significant component of forward motion. However, the detailed path of the sheet during the drop is more complex and is dictated by the scissoring movement of the support arms to minimize sliding motion. The scissoring action of the support arms places the crossing point of the arms near to the forward edge of the sheet in the second position, supporting the forward edge fully. The portion of the paper near the rearward edge is supported only at its transverse edges, causing the center to sag and bow downwardly. When the support arms are pivoted outwardly from the second to the third position, the rearward edge of the sheet falls first in this arrangement.

The collection tray or receptacle is preferably constructed so that there is a slight upward angle from the location adjacent the front of the printer to the location further from the front of the printer. As the sheet falls, rearward edge first, the rearward edge is urged by gravity and its motion to rest against a back stop on the collection tray. The rearward edge of the sheet of paper thus falls to a location defined by the top sheet of the stack and the back stop. The front portion of the sheet then pivots about this established point as it falls, so that the sheet drops by a combination of falling and pivoting motions. This motion is selected to minimize sliding by ensuring that the sheet comes to rest at a location which is identical from one sheet to the next, except that the sheets are gradually displaced upwardly as the stack of previously deposited sheets grows higher.

After each sheet falls to the top of the stack, the arms are pivoted back from the third or outwardly projecting position to the first or folded position, and the process is repeated for the next sheet of paper.

Thus, the paper drop mechanism of the invention is active in the sense that it is positively driven in coordination with the conveying of the paper past the printhead, rather than being an inert paper guide or the like. The active paper drop mechanism is driven by a relatively simple, yet readily controllable, drive mechanism whose movement is coordinated with the movement of the paper.

The active paper drop mechanism adds little weight, complexity, and cost to the printer, but greatly reduces the possibility of the smearing of undried ink on sheets as they lie on the top of the collection stack. The size of the "footprint" of the printer, when the printer is not in use, is not substantially enlarged, an important feature for users who place the printer on a desktop or other congested space. Other features and advantages of the invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a perspective drawing of a printer utilizing the active paper drop mechanism of the invention, with a portion of the cover shown in phantom lines so that the interior mechanism is visible;

FIG. 2 is a perspective drawing of the printer of FIG. 1, with the support arms in the first position;

FIG. 3 is a perspective drawing in the same view as FIG. 2, but with the support arms intermediate between the first and second positions;

FIG. 4 is a perspective drawing in the same view as FIG. 2, but with the support arms in the second position;

FIG. 5 is a perspective drawing in the same view as FIG. 2, but with the support arms in the third position;

FIG. 6 is an interior perspective view of a detail of the printer of FIG. 1, illustrating the active paper drop mechanism.

DETAILED DESCRIPTION OF THE PREFERRED EMBODIMENT

Figure 7:
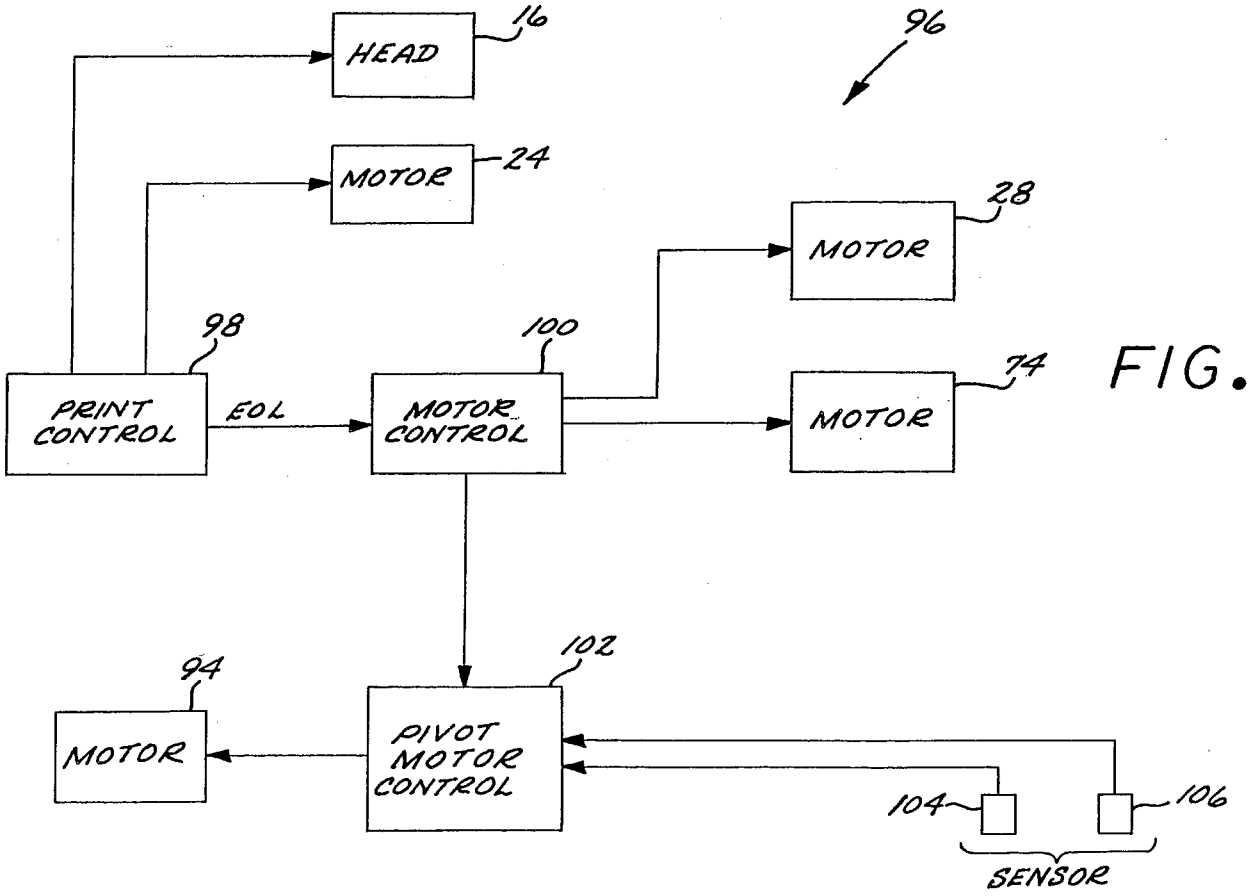
FIG. 7 is a block diagram of the control system of the printer of FIG. 1.

As illustrated in FIG. 1, a printer 10 includes a paper conveying system 12 that moves a sheet of paper 14 past a printhead 16 along a paper path 18, here indicated as a portion of a plane upon which the paper moves. The printhead 16 is preferably, but not necessarily, an inkjet printhead, such as a thermal inkjet printhead, of the types described in the articles printed in the Hewlett Packard Journal, Volume 36, Number 5 (May 1985), whose disclosure is herein incorporated by reference. The printhead 16 is slidably mounted on a rail 20 extending transversely to the paper path 18, and is reciprocated over the sheet 14 from side to side, between the transverse edges 22 of the sheet of paper, by a motor 24. As the printhead 16 moves, a controller causes droplets of ink to be ejected from orifices in the printhead 16 facing the sheet of paper 14, to deposit characters onto the paper. Such characters may be letters, numbers, drawings, or such other patterns as may be desirably printed.

The paper conveying system 12 includes a platen 26 in the form of a roller, and a stepping motor 28 whose operation is coordinated with the movement of the printhead 16, so that as each line of printing is completed the paper is advanced along the paper path 18 by an amount equal to the selected spacing between lines of print. Thus, the sheet of paper 14 moves forwardly in a semi-continuous, incremented fashion as the printing is performed. A forward edge of the sheet 30 is the edge that first emerges from the printer 10.

A pair of support arms 32 are respectively supported at a location adjacent a front face 34 of the printer 10 by a pair of vertically oriented axles 36. The axles 36 are positioned sufficiently far apart and outwardly from the transverse edges 22 of the sheet of paper 14 so that the sheet of paper 14 passes between them as it emerges from the printer along the paper path 18. Each support arm 32 is selectively and controllably pivotable on its axle 36 by a support arm drive system 38. The support arms 32 are positioned at a height or vertical location on the axles 36 such that the top surfaces of the arms 32 are adjacent the underside of the paper path 18. The sheet of paper 14 passes over the tops of the support arms 32 as it emerges from the region of the printhead and the paper conveying system 12, moving along the paper path 18.

The operation of the support arms 32 is illustrated in FIGS. 2–5, which present the progression of the pivoting of the arms 32 in relation to the movement of the sheet of paper 14, as the sheet of paper 14 is incrementally moved forward by the paper conveying system 12. In FIG. 1, the forward edge 30 of the sheet of paper is just beginning to emerge from the paper conveying system 12. The support arms 32 are in a first or folded position 40, wherein the support arms 32 are pivoted on their axles 36 to lie flat or nearly flat against the front face 34. The tops of the arms 32 are just below the forward edge 30 of the sheet of paper, so that the forward edge 30 is supported on the tops of the arms 32 if it sags. Normally, however, at this early stage of emergence of the sheet of paper 14, the unsupported length of paper is sufficiently small that the rigidity of the paper prevents it from sagging.

As the sheet of paper 14 moves incrementally forward, the support arms 32 begin to unfold in the manner illustrated in FIG. 3, by pivoting outwardly from their first position 40. The rate of pivoting is controlled so as to match the rate of forward advance of the sheet of paper 14, preferably keeping the tips 42 of the arms 32 a short distance behind the forward edge 30 of the sheet of paper. The arms 32 thus form a scissors pattern in that they cross at a crossing point 44, but the arms are not joined together at the crossing point 44 in the manner of cutting scissors. As the sheet of paper 14 emerges ever-increasing amounts from the front face 34 of the printer, there is an increasing tendency for the sheet to sag downwardly toward the top surfaces of the arms 32. When such sagging occurs, the underside of the sheet 14 contacts the upper surfaces of the arms 32, and the sagging is arrested. The sheet 14 therefore continues outwardly from the printer along generally the same planar paper path 18 that it would have followed had it been made of an entirely rigid material.

In the intermediate position illustrated in FIG. 3, virtually the entire width and length of the sheet 14 are supported, but it is apparent that, as the arms 32 continue to pivot outwardly away from the first position 40, the greatest support from the arms 32 is provided nearest to the forward edge 30 of the sheet of paper. The portion of the sheet nearest the front face 34, that is, the portion most recently emerging from the printer 10, is supported only along its outer edges near the transverse edges of the sheet of paper 22 by the arms 32. There is therefore a tendency for the sheet in that region to bow downwardly, as illustrated at numeral 49 in FIG. 4. This bowing 49 of the trailing portion of the sheet of paper 14 is intentional in the design of the arms 32.

As the incremental outward pivoting of the arms 32 continues, eventually the sheet of paper 14 completes its contact with the paper conveying system 12 as a rearward edge 46 of the sheet of paper leaves the paper conveying system 12, and the sheet 14 is not advanced further. This point is termed the path end position, as it defines the end of the paper path 18. At this point, the pivoting support arms 32 have reached the position termed the second position 48, illustrated in FIG. 4. It will be seen that the view of FIG. 3, then, is of an intermediate position between the first position 40 and the second position 48.

When the sheet of paper 14 is in the position illustrated in FIG. 4, with the arms 32 in the second position 48, there is a considerable downward bowing 49 of the sheet 14 near its rearward edge 46. The arms 32 are angled outwardly at an angle that depends upon the length of the sheet 14, but is typically greater than 45 degrees, so that the support afforded to the sheet 14 by the arms 32, in the region rear the rearward edge 46, is considerably diminished as compared with the support near the forward edge 30.

When the pivoting of the arms 32 has reached the second position 48 of FIG. 4, there is preferably a pause in the incremental pivoting action, to permit the ink on a previously deposited sheet 50 on the top of a stack 52 in a collection tray 54 to dry as long as possible before the sheet 14 is dropped. A slight delay is permitted and desirable, because there is some delay in the feeding of the next sheet by the paper conveying system 12.

After the slight pause, the arms 32 are pivoted rapidly from the second position 48 further outwardly to a third position 56 illustrated in FIG. 5. In the third position 56, the arms 32 are at nearly a 90 degree angle straight outwardly from the front face 34. The angle need not necessarily be 90 degrees, but must be sufficiently great that the sheet 14 is no longer supported upon the tops of the arms 32, and falls generally vertically downwardly to rest on the top of the previously deposited sheet 50.

As discussed earlier, the dropping action is a combination of vertical and pivoting motion in the sheet. This approach increases the certainty that the sheet 14 will fall to the same position as did the prior sheet, minimizing sliding. When a sheet of paper is dropped from a height without this controlled dropping motion, it tends to slip from side to side as it drops. The vertical drop approach of the invention reduces the amount of sliding between the sheets 14 and 50 that might otherwise occur, thereby reducing the likelihood that any as-yet undried ink on the top face of the sheet 50 will be smeared or smudged by its contact with the underside of the sheet 14.

The collection tray 54 includes a back stop 58, preferably in the form of a back wall. The collection tray 54 is mounted so that the back end of the tray, closest to the front face 34, is slightly lower than the end further from the front face 34. Because of the downward bow adjacent the rearward edge 46 of the sheet in the second position 48, the rearward edge 46 drops first, before the forward edge 30. As the sheet 14 drops in this manner, the rearward edge 46 tends to settle against the back stop 58, which provides a fixed guide for the fall and fixed location against which the sheet 14 rests at the completion of its descent. The forward edge 30 then pivots about this fixed location as it falls. Since the previously deposited sheet 50 fell under substantially the same conditions, the two sheets tend to fall precisely on top of each other, further reducing the chances of sliding and smearing of the ink on the sheet 50.

After the sheet 14 has fallen clear, the arms 32 are pivoted in the opposite direction, to return them to the first position 40, so that the active paper drop cycle may be repeated.

FIG. 6 illustrates the preferred operating mechanism for paper conveying and pivoting the arms 32 in greater detail. The paper conveying system 12 includes two separate stations of conveying. At a first station 60, a planar drive plate 62 is disposed just above the paper path 18. The underside of the drive plate 62 is covered with a low friction material such as polytetrafluoroethylene (teflon) to reduce the sliding friction with the sheet 14. Disposed oppositely the drive plate 62, just below the paper path 18, is the platen 26 that presses the sheet 14 against the plate 62 and drives the sheet 14 forwardly by the frictional contact. The platen 64 is a rubber-covered wheel driven by the motor 28.

Spaced on the other side of the path described by the printhead 16 as it rides on the rail 20, but adjacent the paper path 18, is a second station 68 of the paper conveying system 12. The second station 68 includes a plurality of rubber-covered drive rollers 70 mounted on an axle 72 extending transversely to, and just below, the paper path 18. The axle 72 is turned by a motor 74. A corresponding plurality of oppositely disposed idler wheels 76 are mounted on an axle 78 extending transversely to, and just above, the paper path 18. The rollers 70 and idler wheels 76 contact each other so as to gently grasp the sheet 14 therebetween. The motor 74 is turned to move the rollers 70 at a slightly greater linear surface speed than the platen 26, to keep a slight tension in the sheet 14. The tension holds the sheet 14 flat so that the vertical distance between the printhead 16 and the sheet 14 is constant, to maintain a high quality of the print on the paper.

As indicated, the arms 32 are pivotably mounted on axles 34. Each arm 32 has a protruding peg 80 and a ball 82 on the end thereof, at a point near the mounting location on the axles 34. The ball 82 engages a cam 84 on whose cam surface the ball rides. Rigidly mounted to the cam 84 is a gear segment 86. The combination of cam 84 and gear 86 are pivotally supported on a horizontally disposed cam shaft 88. The gear 88 engages another gear 90, mounted on the shaft of a reversing stepping motor 94. When the motor 94 is actuated, the arms 32 turn accordingly. The motion of the arms 32 is incremental from the first to the second positions in the preferred approach, although a continuous movement would be acceptable.

FIG. 7 schematically illustrates the control mechanism 96 for the printer 10. A print controller 98 decodes the signals to be printed to form commands for the ejection of ink droplets from the printhead 16. The controller 98 also commands the carriage motion motor 24 to move the printhead 16 along the rail 20. As the printing of each line is complete, the print controller 98 sends an end-of-line (EOL) signal to a paper conveying system motor controller 100, which in turn generates control signals for the first station motor 28 and the second station motor 74. As indicated, these motor speeds are adjusted to maintain a slight tension in the sheet of paper 14.

The motion of the pivoting motor 94 is controlled by a controller 102, that receives signals from several sources. The presence of paper is signalled by two paper sensors, which operate by sensing the reflectivity of the paper as it passes by the sensor. A first paper sensor 104 is mounted on the printhead 16, and senses passage of the leading edge of the paper. A second paper sensor 106 is mounted to the frame of the printer 10 at a point along the paper path 18 so that the paper passes the sensor 106 prior to passing the sensor 104. The signals received from the sensors 104 and 106 permit the length and movement of the sheet of paper to be determined by the controller 102, in conjunction with the rate of forward movement of the sheet 14 from the drive motor controller 100. The stepping motor controller 102 then signals the motor 94 to step from the first position to the second position so that the tips 42 just trail the forward edge 30 of the sheet of paper. The controller 102 also provides the optional delay for a pause at the second position, and then signals the motor to move the arms 32 to the third position to permit the sheet 14 to drop. After the sheet 14 has dropped to the stack 52, the motor 94 is actuated to return the arms 32 to the first position.

The present invention provides a simple, lightweight approach for ensuring an accurate, reproducible drop of sheets of paper onto a stack, minimizing the possibility of smearing the ink due to sliding of the paper. Although a particular embodiment of the invention has been described in detail for purposes of illustration, various modifications may be made without departing form the spirit and scope of the invention. Accordingly, the invention is not to be limited except as by the appended claims.

What is claimed is:

1. A printer, comprising:

means for printing characters on sheets of a printing medium;

means for conveying the sheets of the printing medium from the means for printing, along a printing medium path to a path end position overlying a collection station whereat a stack of the sheets is formed; and means for stacking the sheets at the collection station, the means for stacking including movable support arm means for supporting each sheet over the stack as the sheet is conveyed along the printing medium path to the path end position by the means for conveying, and for permitting the sheet to fall onto the stack after the sheet reaches the path end position, the support arm means including a support arm disposed to be selectively positioned under the central portion of the sheet as the sheet moves along the printing medium path.

2. The printer of claim 1, wherein the movable support arm means includes two movable support arms, one supported from each side of the paper path.

3. The printer of claim 1, wherein the movable support means includes a support arm supported from a location adjacent the printing medium path.

4. The printer of claim 3, wherein the support arm is pivotally supported, so that the support arm may pivot about an axis perpendicular to the printing medium path, from a first position wherein the arm is disposed across and below the printing medium path, to a second position angularly disposed across and below the printing medium path, to a third position whereat the arm is not below the printing medium path so that the printing medium can fall to lie upon the stack.

5. The printer of claim 4, further including a drive mechanism that pivots the support arm from the first position to the second position to the third position.

6. The printer of claim 5, wherein the drive mechanism moves the support arm in a stepwise fashion from the first position to the second position as the printing medium advances toward the path end position, and pivots the support arm rapidly from the second position to the third position after the printing medium has reached the path end position.

7. The printer of claim 1, further including printing medium supply means for providing a supply of the printing medium to the means for printing.

8. The printer of claim 1, wherein the means for printing includes a printhead disposed to move in a reciprocating fashion over the printing medium path, whereby characters are printed on the printing medium as it is conveyed by the means for conveying.

9. The printer of claim 8, wherein the printhead is an inkjet printhead.

10. The printer of claim 8, wherein the printhead is a thermal inkjet printhead.

11. A printer, comprising:

means for printing characters on sheets of a printing medium;

means for conveying the sheets of the printing medium from the means for printing, along a printing medium path to a path end position overlying a collection station whereat a stack of the sheets is formed; and two movable support arms, each support arm being pivotally supported from a location laterally adjacent the printing medium path by an axle that is perpendicular to the printing medium path so that the support arm may pivot in a plane parallel to that of the printing medium path, from a first position wherein the arm is transversely disposed across and below the printing medium path, to a second position wherein the arm is angularly disposed across and below the printing medium path, to a third position whereat the arm is not below the printing medium path so that the printing medium can fall to lie upon the stack; and a drive mechanism that controllably pivots each support arm from its first position to its second position to its third position and then back to its first position after the sheet has fallen.

12. The printer of claim 11, wherein the means for printing includes a printhead disposed to move in a reciprocating fashion over the printing medium path, whereby characters are printed on the printing medium as it is conveyed by the means for conveying.

13. The printer of claim 12, wherein the printhead is an inkjet printhead.

14. The printer of claim 12, wherein the printhead is a thermal inkjet printhead.

15. A printer, comprising:

a paper conveyor that grasps a sheet of paper and moves the paper;

a printhead slidably mounted so that it may be traversed past the sheet of paper moved by the paper conveyor, in the direction transverse to the motion of the sheet;

a pair of support arms mounted from axles positioned on either side of the path followed by the sheet of paper as it moves on the paper conveyor after it has passed the printhead; and a motor that causes the support arms to pivot on their respective axles, between a position whereat the arms are positioned across, and below, the sheet of paper, and a position whereat the arms are not below the sheet of paper, so that the sheet may fall.

16. The printer of claim 15, wherein the printhead is an inkjet printhead.

17. The printer of claim 15, wherein the printhead is a thermal inkjet printhead.

18. The printer of claim 15, wherein the paper conveyor frictionally grasps the sheet of paper.

* * * * *